US006871885B2

(12) United States Patent
Goldenberg et al.

(10) Patent No.: US 6,871,885 B2
(45) Date of Patent: Mar. 29, 2005

(54) COMBINATION CAM LOCK/TILT LATCH AND LATCHING BLOCK THEREFOR WITH ADDED SECURITY FEATURE

(75) Inventors: Shaul Goldenberg, Vaughan (CA); Sean Davies, Vaughan (CA)

(73) Assignee: 420820 Ontario Limited, Vaughan ( * ) Notice: Subject to any disclaimer, the term of this patent is extended or adjusted under 35 U.S.C. 154(b) by 0 days.

(21) Appl. No.: 10/114,936

(22) Filed: Apr. 4, 2002

(65) Prior Publication Data

US 2002/0145291 A1 Oct. 10, 2002

(30) Foreign Application Priority Data

Apr. 5, 2001 (CA) ..... 2343503

(51) Int. Cl.[7] ..... E05C 3/04

(52) U.S. Cl. ..... 292/241; 292/4; 292/5; 292/14; 292/240; 292/DIG. 20; 49/449

(58) Field of Search ..... 292/240, 241, 292/4, 5, 14; 49/449, 451, 260, 150, 158, 157, 176, 181, 445

(56) References Cited

U.S. PATENT DOCUMENTS

| | | | | | |
|---|---|---|---|---|---|
| 3,896,404 | A | | 7/1975 | Peterson | 335/205 |
| 4,167,835 | A | * | 9/1979 | Nobes et al. | 49/449 |
| 4,227,345 | A | * | 10/1980 | Durham, Jr. | 49/181 |
| 4,253,688 | A | * | 3/1981 | Hosooka | 292/52 |
| 4,363,190 | A | * | 12/1982 | Anderson | 49/181 |
| 4,475,311 | A | * | 10/1984 | Gibson | 49/176 |
| 4,525,952 | A | * | 7/1985 | Cunningham et al. | 49/449 |
| 4,553,353 | A | * | 11/1985 | Simpson | 49/161 |
| 4,590,708 | A | * | 5/1986 | Campodonico | 49/181 |
| 4,610,108 | A | * | 9/1986 | Marshik | 49/181 |
| 4,901,475 | A | * | 2/1990 | Simpson | 49/175 |
| 4,955,159 | A | * | 9/1990 | Rogers | 49/161 |
| 4,961,286 | A | | 10/1990 | Bezubic | 49/175 |
| 5,007,199 | A | | 4/1991 | Dunagan et al. | 49/13 |
| 5,127,192 | A | * | 7/1992 | Cross | 49/181 |
| 5,139,291 | A | * | 8/1992 | Schultz | 292/42 |
| 5,157,808 | A | * | 10/1992 | Sterner, Jr. | 16/197 |
| 5,164,705 | A | | 11/1992 | Dunagan et al. | 340/547 |
| 5,165,737 | A | * | 11/1992 | Riegelman | 292/42 |
| 5,301,467 | A | * | 4/1994 | Schmidt et al. | 49/181 |
| 5,356,667 | A | | 10/1994 | Hench et al. | 427/384 |
| 5,697,188 | A | * | 12/1997 | Fullick et al. | 49/181 |
| 5,715,631 | A | | 2/1998 | Kailian et al. | 49/450 |
| 5,901,499 | A | * | 5/1999 | Delaske et al. | 49/183 |
| 5,927,014 | A | | 7/1999 | Goldenberg | 49/182 |
| 5,946,857 | A | | 9/1999 | Davies et al. | 49/260 |
| 5,992,907 | A | | 11/1999 | Sheldon et al. | 292/34 |
| 6,076,304 | A | | 6/2000 | Carrier | 49/342 |
| 6,119,398 | A | * | 9/2000 | Yates, Jr. | 49/181 |
| 6,135,510 | A | | 10/2000 | Diginosa | 292/145 |
| 6,230,443 | B1 | * | 5/2001 | Schultz | 49/183 |
| 6,588,150 | B1 | * | 7/2003 | Wong et al. | 49/183 |
| 2001/0038210 | A1 | * | 11/2001 | Subliskey | 292/5 |

* cited by examiner

*Primary Examiner*—Daniel P. Stodola
*Assistant Examiner*—Carlos Lugo
(74) *Attorney, Agent, or Firm*—Neil H. Hughes; Ivor M. Hughes; Marcelo Sarkis

(57) ABSTRACT

A latch reinforcing block for engagement with the nose portion of any tilt latch assembly and preferably with the above-mentioned camlock/tilt latch combination, said block comprising a top and bottom and having extending from proximate the top to proximate the bottom there-through fastening portions to fasten said reinforcing block within the track of a preferred window assembly, said reinforcing block having disposed proximate the top thereof at least one cutout, notch or pocket extending towards the bottom and for receipt of a corresponding nose portion of the latch assembly in order to pass loads such as wind loads or the like to the frame section to which the reinforcing block is attached.

5 Claims, 22 Drawing Sheets

COMBINATION CAM LOCK/TILT LATCH AND LATCHING BLOCK THEREFOR WITH ADDED SECURITY FEATURE

FIELD OF THE INVENTION

This invention relates to improvements for window locks for sashes which are both slideable and rotatable or tiltable such as single hung, double hung, sliding or tilt and slide window.

BACKGROUND OF THE INVENTION

A window lock and its use for a single hung, double hung, or sliding window or the like is known. Typically, a cam-lock and its housing are centrally attached to a framing part of a moveable inner window sash and the cam-lock is moved by a handle into and out of engagement with a slot or keeper disposed with an outer frame part or window sash . In order to tilt the window away from the frame a separate operator accessible tilt latch is required adjacent each end of the free end of a pivoting window. These latches are moved into and out of engagement with the track to permit tilting of the window and include spring biased plungers which normally engage in the tracks and which are retractable by the user by the operation of a separate operator engaged with the plunger.

Past structures for a tilt latch include a plunger having a nose portion which typically engages the track of the window assembly. The ability of the latch to wind loads can depend on the depth to which the nose portion extends into the track. The only portion available to stop the nose from releasing from the track under for example higher wind loads is the actual track profile itself which depending on the thickness of the vinyl utilized, could result in the inadvertent release of the nose portion and hence the tilt latch resulting in potential damage to the window assembly. In order to address this problem, our prior patent, U.S. Pat. No. 5,946,857 teaches in FIGS. 13 and 13C an adjustable block assembly which includes a portion (202) to receive the nose portion (251). In our prior patent the adjustable block system is incorporated with a central locking system and is utilized to reinforce the latch portion (251) in the triangular shaped detent of the block. Since the adjustable block is fixed to the frame any force tending to unlatch the nose portion of the latch (251) will be passed on to the frame instead of to the vinyl track. However, such an installation is quite costly and does not find application generically within various window assemblies. It would therefore be advantageous to provide such a block mechanism for incorporation in simpler structures while providing an improved reinforcing for the latch and particularly for the combination cam lock/tilt latch of the present invention.

It is also known in the art to provide various forms of simplified latches. For example, U.S. Pat. No. 5,715,631 attempts to combine a cam lock with a tilt latch but it is required that a separate latching portion be included within the sash framing part which renders the construction difficult to implement universally.

U.S. Pat. No. 5,139,291 teaches a flush mounted tilt latch for a window which includes a finger operator (74) to operate a plunger portion (47).

U.S. Pat. No. 5,992,907 teaches a lock and tilt latch combination which may be double acting.

U.S. Pat. No. 5,356,667 teaches a tilt latch for a sliding window which is simple but which may not be reliable in terms of its locking capacity. This is true also for U.S. Pat. No. 6,135,510.

U.S. Pat. No. 6,076,304 teaches a latching assembly including a rack and pinion member operated by a user accessible handle and including a tab (58) to operate said latch.

U.S. Pat. No. 4,961,286 also includes a tilt latch which is simple and which may also be toggled as seen in FIG. 2 therein.

Nowhere in the prior art is there provided a simple combined cam lock/tilt latch which is surfaced mounted, and which may be utilized with any window construction.

It is also known to provide security systems in combination with window assemblies. Examples of such systems are found in U.S. Pat. No. 5,164,705 and U.S. Pat. No. 5,007,199 which includes a magnet (14) contained within a pivot shoe (70) which may slide in a track portion to and from the reed switch sensor (15) disposed within the alarm system (90) contained within the jam portion. The alarm system therefore is pre-installed in the window and may be sold as original equipment or on replacement windows. Further U.S. Pat. No. 3,896,404 teaches a hinge having two leafs with a magnet (22) disposed in one leaf and the read switch (26) disposed in the other leaf with the security system being alarmed when the hinges are located proximate one another, and with the hinge being installable within any door, being pre-wired and thereby being adaptable to security systems.

It would therefore be advantageous to include with a tilt latch reinforcing block for a track for a single hung, double hung, sliding or tilt and slide window the necessary receiver portions of a security system fixed in position in relation to a tilt latch nose portion carrying the transmitter. Alternatively it is heretofore unknown to have the transmitter and receiver for a security system integrated with a camlock and keeper or slot of a latch assembly.

It is also known to provide a tilt latch for an outside sash member for a window assembly. It is also known that the outside sash member can only be tilted inwardly for cleaning because of the window framing section on the exterior of the building it is not possible for the outside sash to pivot outwardly. When the inside sash therefore is in it's lock position, wind loads are passed from the outside sash to the inside sash relying on the locking mechanism and the tilt latch assembly for whatever resistance it may provide to the wind load. Many of the latch systems utilized on the outside window sash are excessive and it would be advantageous to simplify such a latch to a one piece latch system with accomplishes all the necessary objectives for an outside sash latch while simplifying the expense of manufacture and installation.

It is also known within the industry to provide a clamping pivot shoe as taught in U.S. Pat. No. 5,927,014 to Mr. Shaul Goldenberg, one of the inventors of this present invention. As best seen in FIGS. 14, 19, 22, and 22B of U.S. Pat. No. 5,927,014 a clamping system requires that flanges that extend laterally or vertically from the track be provided in the window assembly with these track flanges riding at all times within the gap (130) between the two clamping surfaces (P2 and P3). These clamping surfaces P2 and P3 therefore do not carry the laterally extending flanges but there is a manufacturing clearance made available in order for the clamping assembly to move freely in the track when it is free to do so, and for the clamping to take effect only when the operator for example, handle (140) is moved to a horizontal position as seen in FIG. 20 in that particular patent. As seen in FIG. 22A such a system is preferably embodied between two pivot shoes (100 and 500) which are interconnected by interconnecting portion (520). Although such a system works very well, it may be uneconomical for many window producers because of the stiff competition found in the market place. It would therefore be advantageous to provide a clamping system which has most of the advantages of those taught in U.S. Pat. No. 5,927,014 to Mr. Goldenberg while reducing the cost of such a system.

Accordingly, it is an object of the present invention to combine a cam lock and tilt latch into one assembly which will much simplify present known structures and provide broader application in window assemblies.

A primary object of this invention is to provide a combination camlock/tilt latch assembly which much simplifies prior known structures and which is surface mounted to any window assembly where appropriate.

It is a further object of the invention to provide a latch reinforcing block which may be utilized with a tilt latch, and preferably the combination camlock/tilt latch, in order in improve the reinforcement of the latch and its ability to resist wind loads at a higher wind pressure.

It is yet a further object of this invention to provide such a latch reinforcing block which includes at least one latching position and which further incorporates components of a security system so that the security system may be alarmed at both a locked and at a latched position.

It is yet a further object of this invention to provide a cam lock/tilt latch combination which provides for hyperextension of long nose portion at the locked position which nose portion extends well into the track or alternatively within the reinforcing block to further improve the reinforcement of the latch assembly.

It is yet a further object of the invention to provide alarm components within the hardware of a window assembly including the latch reinforcing block and the cam lock/tilt latch combination and the keeper, slot or the like to enable a security system to be pre-wired into a pre-assembled original or replacement window assembly.

It is a further object of the invention to provide a simple one piece outside sash latching mechanism which is inexpensive compact.

It is yet a further object of the invention to provide a quick locking pivot shoe which clamps against the track sections prior to the free end of the pivoting window sash leaving the frame section of the window assembly.

Further and other objects of the invention will become apparent to those skilled in the art when considering the following summary of the invention and the more detailed description of the preferred embodiments illustrated herein.

SUMMARY OF THE INVENTION

According to one aspect of the invention there is provided a combination lock/latch for a window assembly for installation on a moveable sash adjacent a track jamb of the window assembly, and preferably a double hung or tilt and slide window assembly, said combination lock/latch comprising:

1) a housing for said lock/latch having an opening extending therefrom and preferably from the top thereof;
2) a rotatable camlock disposed in the housing, a spindle or alternatively a tab connected to said camlock and extending therefrom through the opening of said housing and having a user accessible part or handle; said camlock having an engaging portion for rotatable engagement/disengagement with a keeper or slot affixed to or disposed with a framing part or an outside sash of said window assembly , said camlock having a detent provided therewith for rotatable engagement with a tilt latch, preferably only after the engaging portion has disengaged the slot or keeper;
3) a preferably one piece biased tilt latch portion having two ends also disposed within said housing and biased to the latched position and having a nose portion proximate one end thereof and a detent portion proximate the other end thereof, said biased latch for engaging a track proximate the nose portion thereof , (and preferably in one embodiment in a latch block proximate said track, said block having at least one pocket for receiving said nose portion of the latch, and in another embodiment said nose extending further into said track or preferred block so as to provide the sash with a higher wind pressure loading capability), and for engagement with the detent of the camlock proximate the detent of said tilt latch proximate the other end thereof, said latch being biased to the track, (or preferred block), engaging position subsequent to being released by rotation of the camlock subsequent to when the engaging portion has disengaged the keeper, wherein said lock/latch combination obviates the need for a separate camlock and a separate tilt latch.

Preferably said detent of said cam-lock is a shoulder and the detent of said tilt latch is a tab disposed at the end of a flexible finger, these parts engaging to convert the rotary motion of said cam to linear motion of said tilt latch. Preferably a return spring is disposed within said housing to engage the tilt latch intermediate said nose and said tab to bias the sliding linear motion of said latch to the track engaging position. In one embodiment the keeper or slot may further comprise a receiver/transmitter for an alarm system while the camlock includes the corresponding transmitter/receiver.

According to yet another aspect of the invention, there is provided a latch reinforcing block for engagement with the nose portion of any tilt latch assembly and preferably with the above-mentioned camlock/tilt latch combination, said block comprising a top and bottom and having extending from proximate the top to proximate the bottom therethrough fastening portions to fasten said reinforcing block within the track of a preferred window assembly, said reinforcing block having disposed proximate the top thereof at least one cutout, notch or pocket extending towards the bottom and for receipt of a corresponding nose portion of the latch assembly in order to pass loads such as wind loads or the like to the frame section to which the reinforcing block is attached, preferably the reinforcing block includes an extra large notch, pocket, cutout or the like in order to engage with the corresponding nose portion of the tilt latch which is able to hyperextend much past the normal extension of such a nose portion into the block to further enhance the reinforcing and load carrying capability of the window assembly. The ability to hyperextend the nose portion of the block is a result of the construction of the tilt latch. For example when the tilt latch is the preferred camlock/tilt latch then the various positions of the handle of the lock will correspond to various positions of the nose of the tilt latch from a fully released position, a subsequent unlocked yet latched position whereat the nose extends partially into the block, to a fully locked position whereat the nose portion hyper-extends into the block.

When the window assembly is a single hung or a double hung window, the reinforcing block may further comprise a counter balance spring mounting block for engagement with the counter balance spring of the single or double hung window assembly, said reinforcing block further comprising a means for engaging the counter balance spring when present and fastening thereto wherein said housing for the counter balance spring and/or said spring is mounted on or fastened to the reinforcing block fastened to sash track allowing motion of the spring while the block is fixed into position relative to said track. Preferably, said reinforcing block for the counter balance spring may be adapted to include at least one reed switch element for a security system, pre-wired thereto and within the sash, so as to enable the security system to be installed in the window assembly as it is manufactured. Preferably the corresponding magnet may be installed with the nose portion of a tilt latch.

When the reinforcing block is installed within a tilt and slide window assembly it may further comprise a body mounted within said track having at least one cut-out, notch, or pocket for receipt of the nose portion of a tilt latch, said body having disposed therein means to enable a security system to be armed, (for example a reed switch or magnet) whether the latch nose is in the locked or in the latched position.

The block therefore provides with the preferred cam-lock/tilt latch combination superior performance of a latching system and it's ability to shed wind pressure loading by having a higher capacity to do so, and further the ability to provide a preinstalled transmitter/receiver components for a security system therefore eliminating unsightly wiring.

In another aspect of the invention a simple tilt latch for an outside sash is provided comprising a one piece member which includes a flexible finger which flexes when the latch is released from a track, or a preferred block disposed in a track, by pulling the sash inwardly away from the frame, a flexible zone disposed with said finger providing the flexing function of the finger in order to release said latch from the track or preferred block. Preferably said finger is a narrow extension extending from the body of the simple tilt latch which flexes away from and toward the track or preferred block as provided by the flexible zone when the latch is released or engaged and which returns by memory to its track engaging position. The simple latch includes mounting openings provided therewith for mounting to the framing portion of the outside sash. In this manner the simple latch is easily released without the need for a separate operator.

According to a primary aspect of the invention there is provided a clamping pivot shoe which unlike Mr. Goldenberg's prior interconnected structure identified in the background of the invention, will clamp quickly and preferably within one degree of rotation as the window pivots in relation to the frame. In this way the need to interconnect the pivot shoe with a separate gliding shoe in the track is eliminated, and problems such as sagging or deforming the seal are obviated.

According to yet another aspect of the invention there is provided a substantially zero clearance clamping pivot shoe, said pivot shoe comprising a top and a bottom and having disposed proximate the top and bottom thereof, camming members having camming elements or surfaces having leading edges and said members preferably being formed from metal, said camming members having disposed therebetween a first and a second track clamping element preferably having braking means provided therewith and preferably at least one supplementary preferably pebbled preferably metal braking part engageable with a clamping element and a track portion for a window assembly disposed and riding between said clamping elements in use, said clamping members each having compatible camming elements or surfaces engagable with respect to the top and bottom camming member elements or surfaces, said top and bottom clamping elements including track engaging parts and track supporting glide posts respectively integrally formed therewith to enable the track to glide unclamped yet supported between the clamping elements when the window is not pivoted, the top of the posts extending above the top of said braking means until the window is pivoted, wherein when the window is pivoted the leading edge of the camming elements/surfaces of the top and bottom members override the camming elements/surfaces of the clamping elements to cause the clamping portions and preferred braking means to move towards one another preferably a distance substantially equal to the sum of the dimensions of the top and bottom camming elements thereby causing the clamping elements to immediately move toward one another and to clamp down on the laterally extending track portion of the window assembly and prevent movement of the sash within the track prior to the window being pivoted more than substantially 1 degree or substantially beyond the angle whereat the free end of the window would no longer be disposed in the track. This action is important to prevent the sash from sagging which might occur if the pivot shoe did not quickly and substantially immediately lock and clamp against the track elements. Preferably the top and bottom camming members and clamping portions include camming elements that are substantially triangular shaped land and groove portions.

The performance for our pivot shoe therefore is substantially equivalent to Mr. Goldenberg's prior clamping structure in function while tremendously simplifying such a structure and reducing the costs.

Preferably the upper clamping member includes a substantially v-shaped camming surface which normally engages a substantially v-shaped camming pocket within the upper clamping member, and preferably the lower camming member includes smaller trapezoidal-shaped camming surfaces which engage with compatibly shaped camming recesses in the lower clamping member to provide the clamping action.

In the preferred embodiment the upper camming member engages with a metal bracket proximate the top thereof and includes a pivot extension portion which extends through the upper and lower clamping member, the lower camming member being secured proximate the bottom thereof preferably via a substantially c-shaped clip engaging a groove provided with said pivot extension portion. Preferably, the metal bracket engaging the upper camming member includes a slot and an outwardly extending leg for engaging with the sash and a corresponding bracket having a generally hat shaped profile fastened to the side of a window sash adjacent the pivoting ends thereof, wherein the hat profile may be slid into the substantially c-shaped profile of the first bracket to fasten the window sash to the pivot shoe assembly and the outwardly extending leg.

BRIEF DESCRIPTION OF THE DRAWINGS

FIG. 8B is a schematic side view of FIG. 8A illustrating the various depths of the pocket contained within a block of the window assembly showing the night latch or vented window position and the locked position in one embodiment of the invention.

DETAILED DESCRIPTION OF THE DRAWINGS

The reader is referred to U.S. Pat. No. 5,946,857 the teaching of which are hereby incorporated by reference in relation to reinforcing block utilized for accepting a nose portion of a tilt latch. Further the prior patent of Mr. Shaul Goldenberg U.S. Pat. No. 5,927,014 is herewith incorporated by reference with respect to clamping feature of a pivot shoe which respect to the laterally extending or vertically extending flanges of a track said flange extending between the clamping shoe at all times; the feature of clamping and the operation thereof being hereby incorporated by reference into this application.

The present installation and embodiments incorporate various inventions which have a synergy in that they work together to improve the overall stability and integrity of the window system within which they are installed. Any window may be utilized and incorporate some or all of the various aspects of the invention including single hung, double hung, sliding, tilt and slide, casement window systems and alike.

Figure 1:
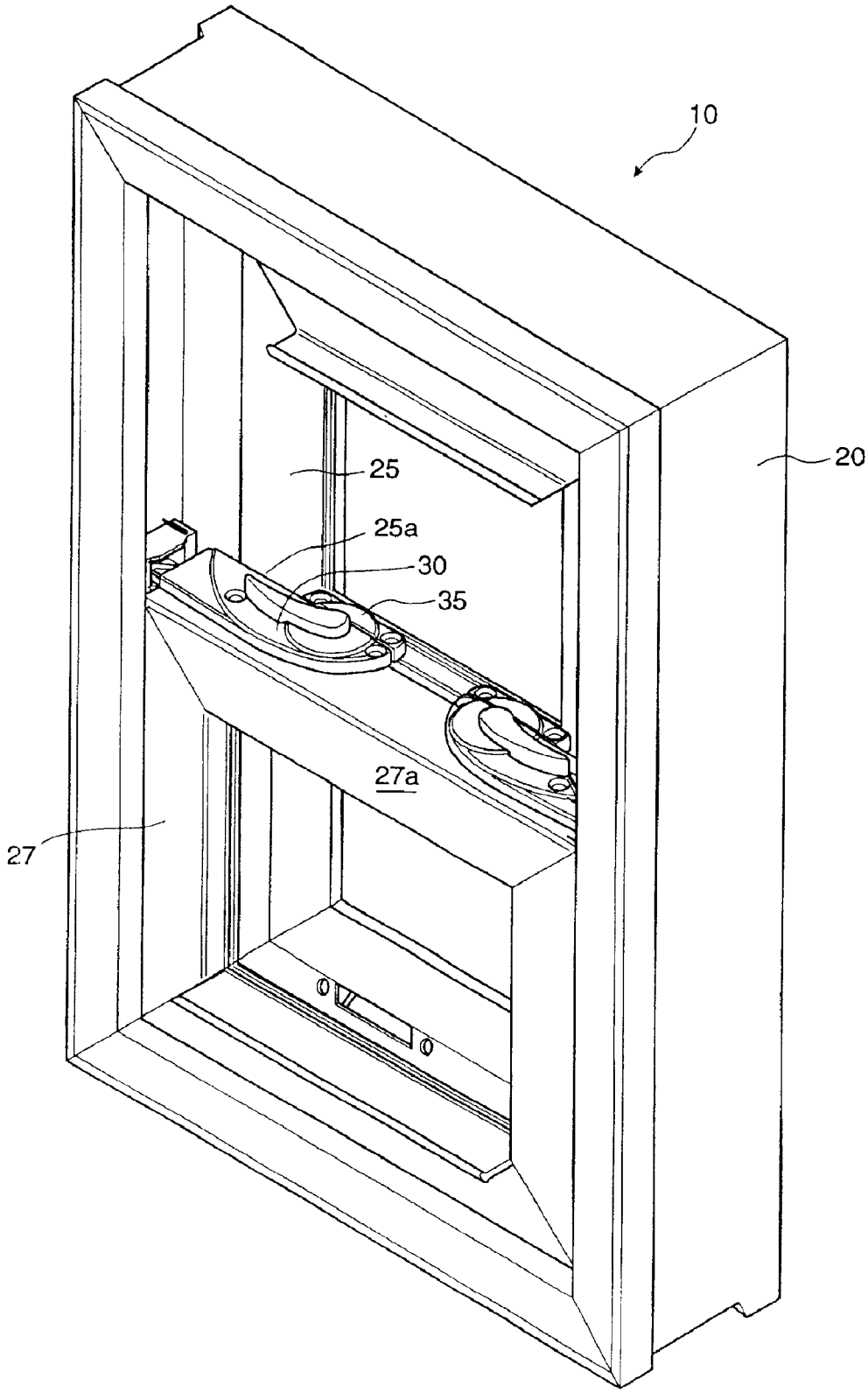
FIG. 1 is a perspective view of a double-hung window assembly containing the combination cam-lock/tilt latch illustrated in one of the embodiments of the invention.
Figure 2:
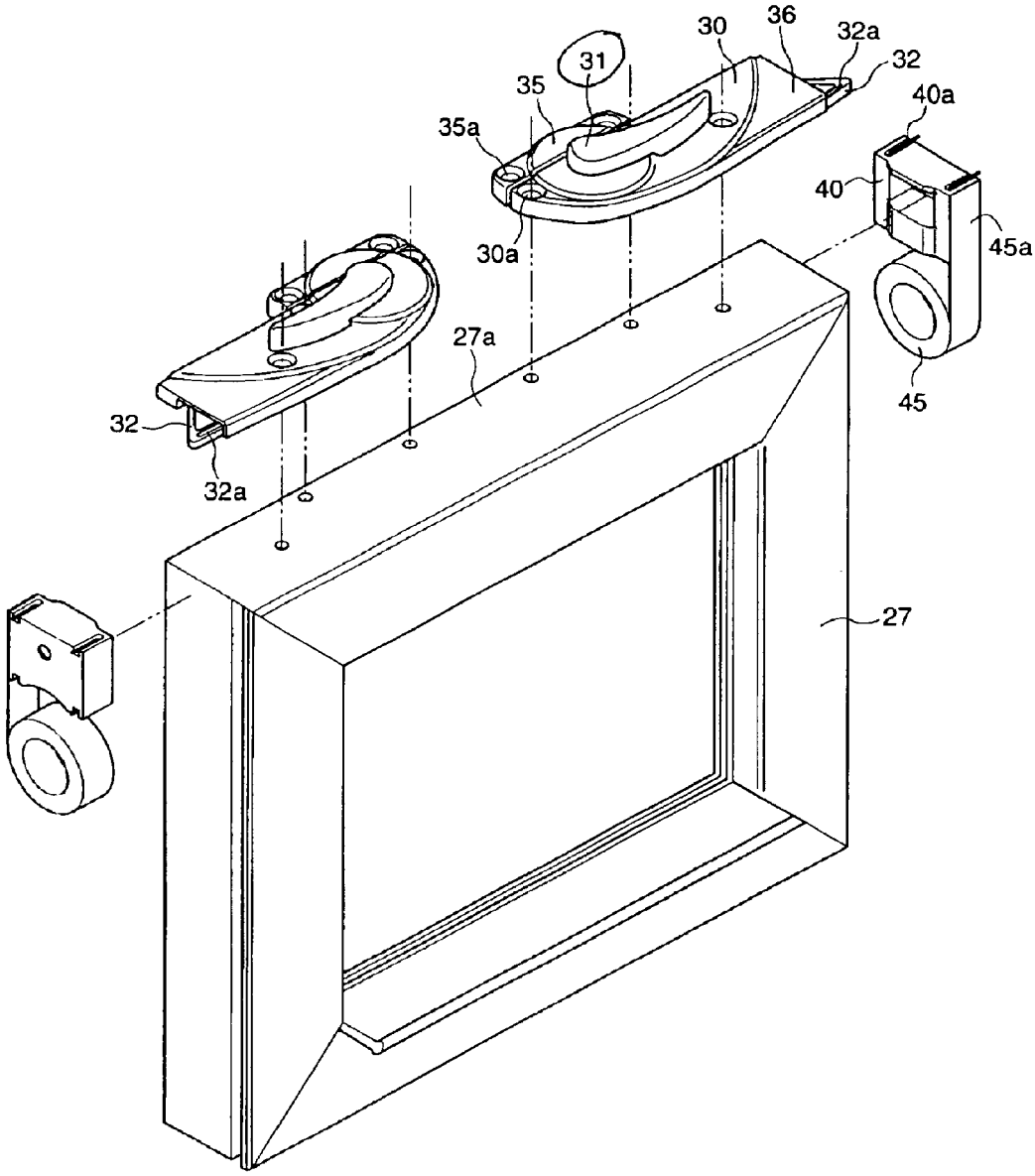
FIG. 2 is an exploded perspective view of the inside window sash of FIG. 1 with the frame portion removed illustrated in one aspect of the invention.

FIG. 1 illustrates in perspective a double hung window assembly 10 incorporating framing sections 20 from which outside window sash 25 and inside window sash 27 are installed. This application will not teach the construction of a double hung and single hung window assembly and the reader is referred to prior teachings in this regard. Suffice it to say that the inside window sash 27 is latched to the outside window sash 25 via cam-lock/tilt lock assembly 30 installed on a header frame section 27*a* of the inside sash 27 locked to the lower frame section 25*a* of the outside sash 25 which contains a keeper portion 35 as best seen in FIG. 3 having a locking detent 35*b* or engagement of cam lock 34 and the engaging part 34*b* of the cam lock 30.

Figure 3:
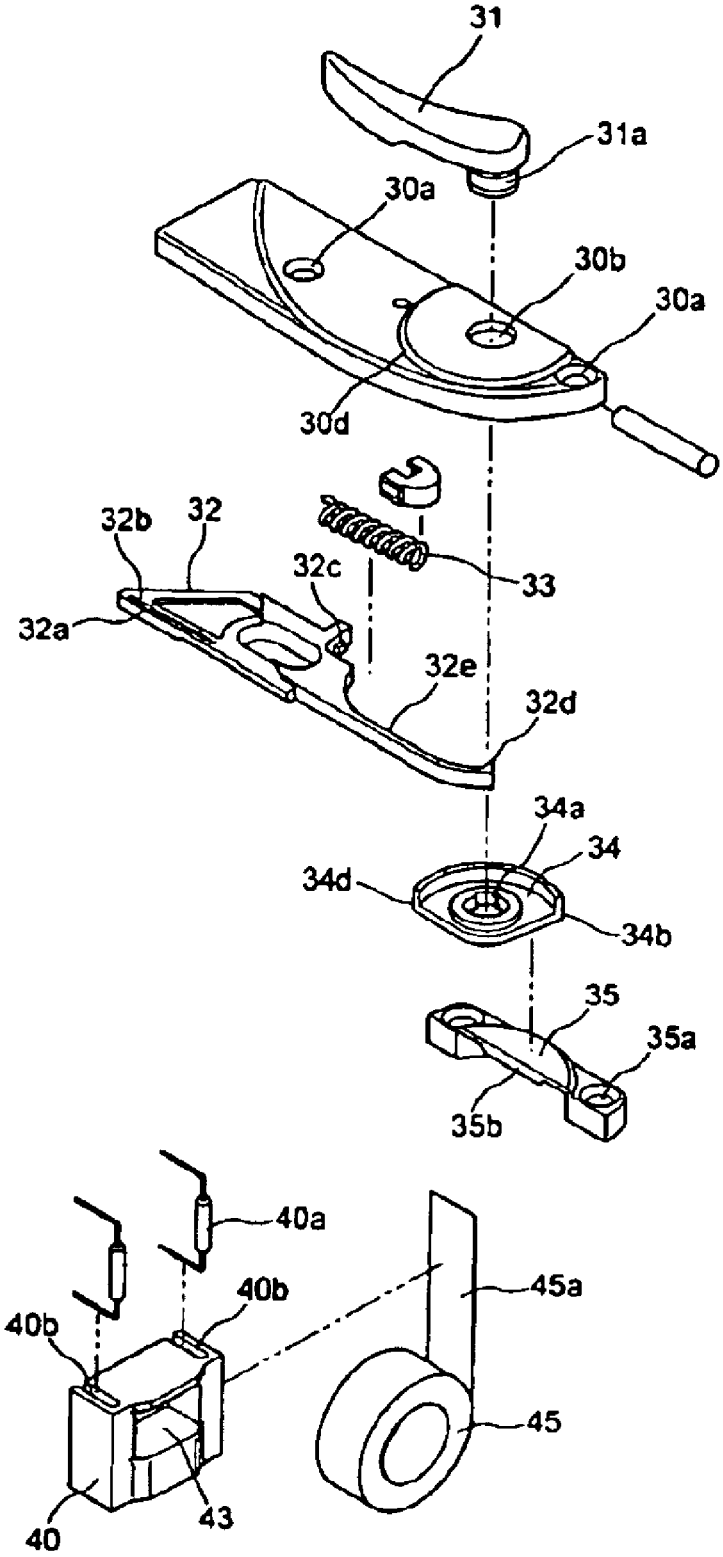
FIG. 3 is an exploded perspective view of the various elements of the invention without the window sash illustrated in a preferred embodiment of the invention.

As best seen in FIG. 3 cam lock 30 includes a handle portion 31 engaged with cam lock 34 via the support shaft 31*a* engaging the opening 34*a* of the cam lock portion 34. Said portion 34 is therefore rotable with respect to the keeper 35 so as to lock and release the cam lock from said keeper 35. Said cam lock 30 includes a housing 36 which contains the operating parts once the housing is installed with the header of the window sash 27 via openings 30*a* with a convenient fastener not shown. The cam lock/tilt latch 30 includes a tilt latch portion 32 fully contained within the housing, which tilt latch is released by the shoulder portion 34*d* of the cam lock 34 when the handle 31 is rotated to the handle position as shown in FIG. 4C, whereat the tilt latch nose portion 32*b* is released from the pocket 43 of the counter spring block portion 40 which will be described hereinafter. The detent or tab 32*d* will engage the shoulder therefore 34*d* in order to release the nose 32*b* from the block pocket 43 when the handle 31 is rotated to move the cam-lock 34 to its released position. The tab 32*d* is located at the end of a flexible section 32*e* which permits the arcuate motion thereof within the housing as the cam-lock portion 34 rotates. The rotation of the cam-lock portion 34 in the direction tending to release the nose portion 32*b* will also cause the flexible portion 32*e* carrying the tab 32*d* to travel with the cam-lock 34 in an arcuate path converting the arcuate motion of the camlock 34 via operation of the handle 31 into a linear motion of the nose 32*b* to thereby release the tilt latch 32 from the block pocket 43. This releasing action will not commence until after the keeper 35 is released by the cam-lock shoulder 34*e* as best seen in FIG. 4B. A return spring 33 is provided within the housing and engageable with pin 32*c* to allow the return of the latch 32 to the sliding position of FIG. 4B from the release position of FIG. 4C subsequent to the operation of handle 31.

As best seen in FIG. 3 the tilt latch 32 has a magnet portion 32*a* disposed therein proximate the nose 32*b* which is used with a security system in combination with the reed switch 40*a* or the like installed within the recesses 40*b* of the counter balance block 40. The alarming system options resulting from these components will be described hereinafter.

Figure 4A:
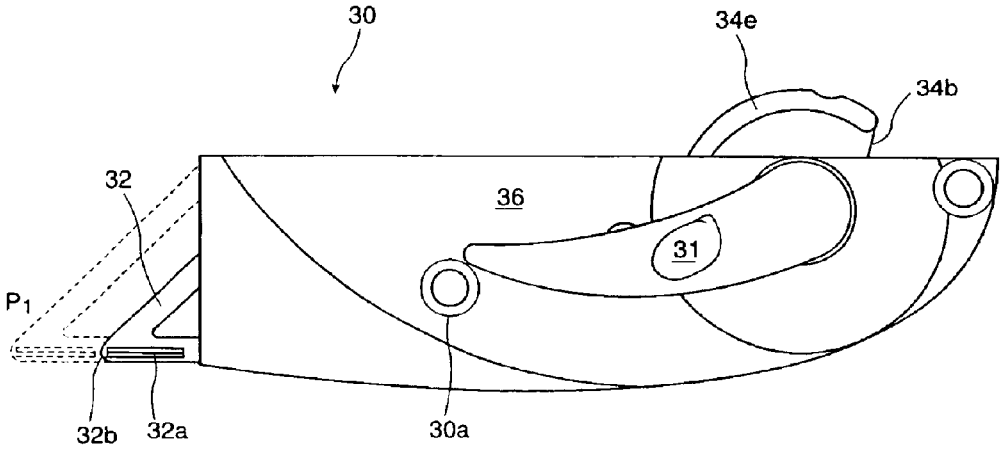
FIGS. 4A, 4B and 4C illustrates various positions in which the handle portion and the nose portion of the cam-lock/tilt latch may be found when the inner sash is locked or is available to slide yet latched or may be tilted respectively and illustrated in preferred embodiments of the invention.
Figure 4B:
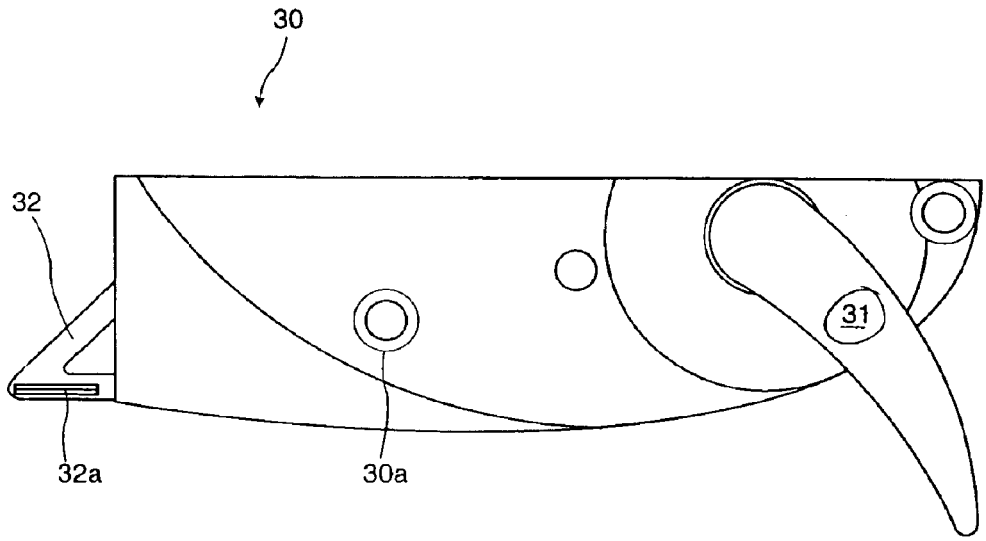
Figure 4C:
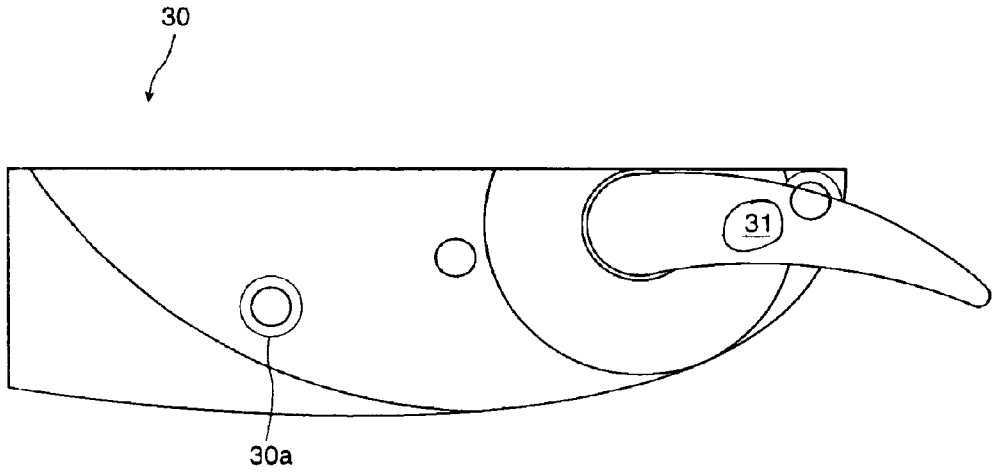
Figure 5A:
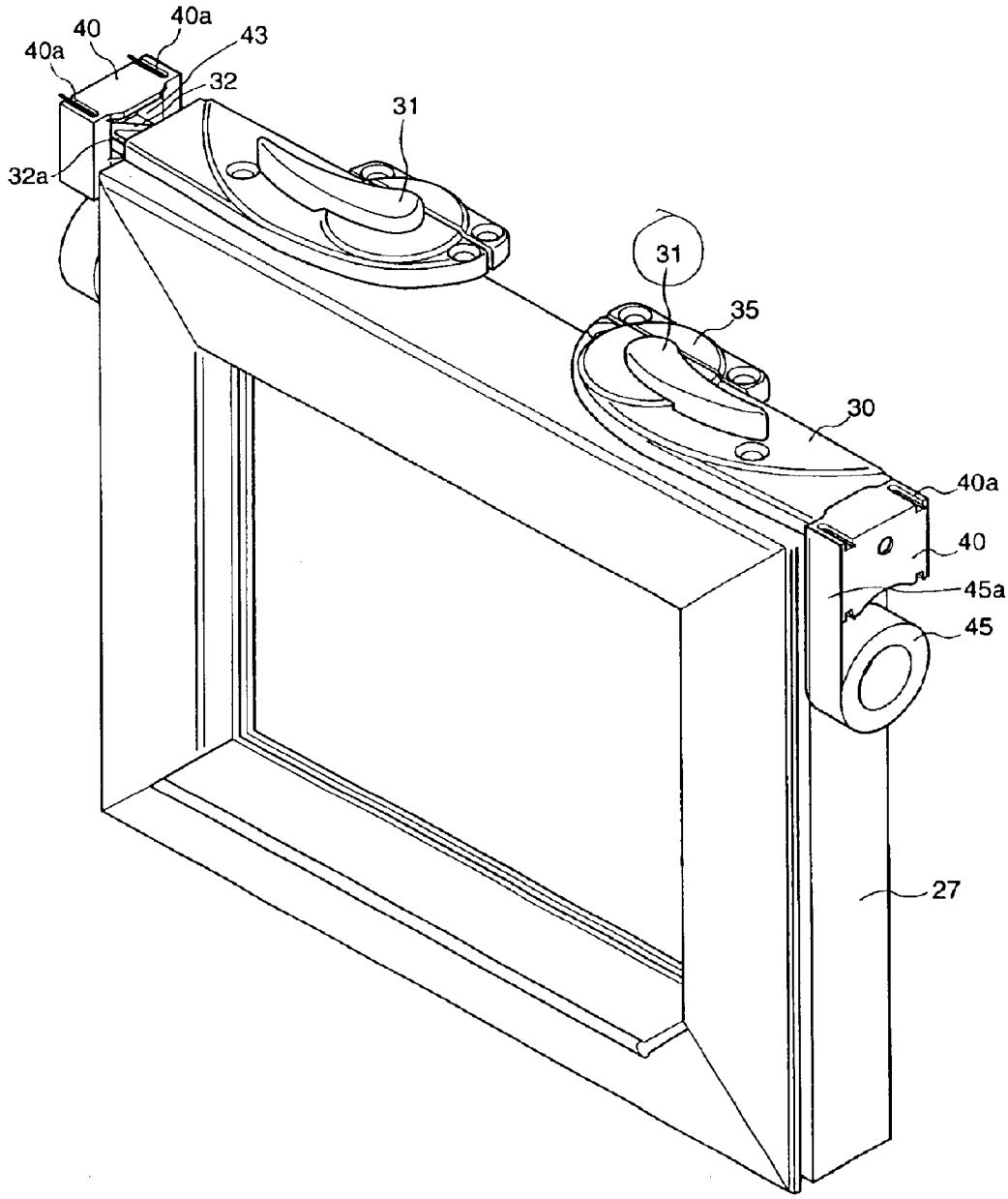
FIGS. 5A and 5B are perspective views of the inside window sash viewed from the inside and outside of the dwelling illustrating the components installed on the window sash.
Figure 5B:
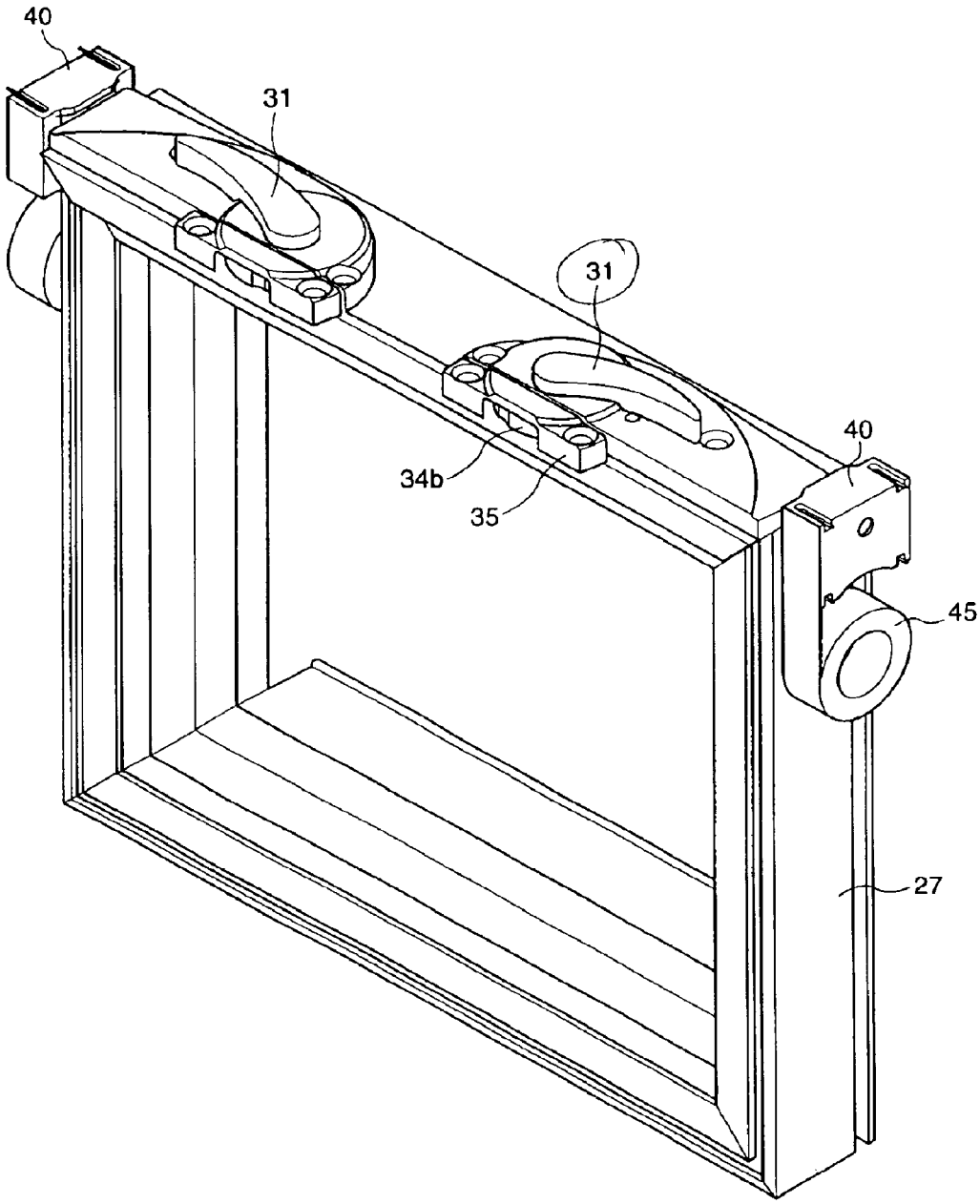
Figure 6:
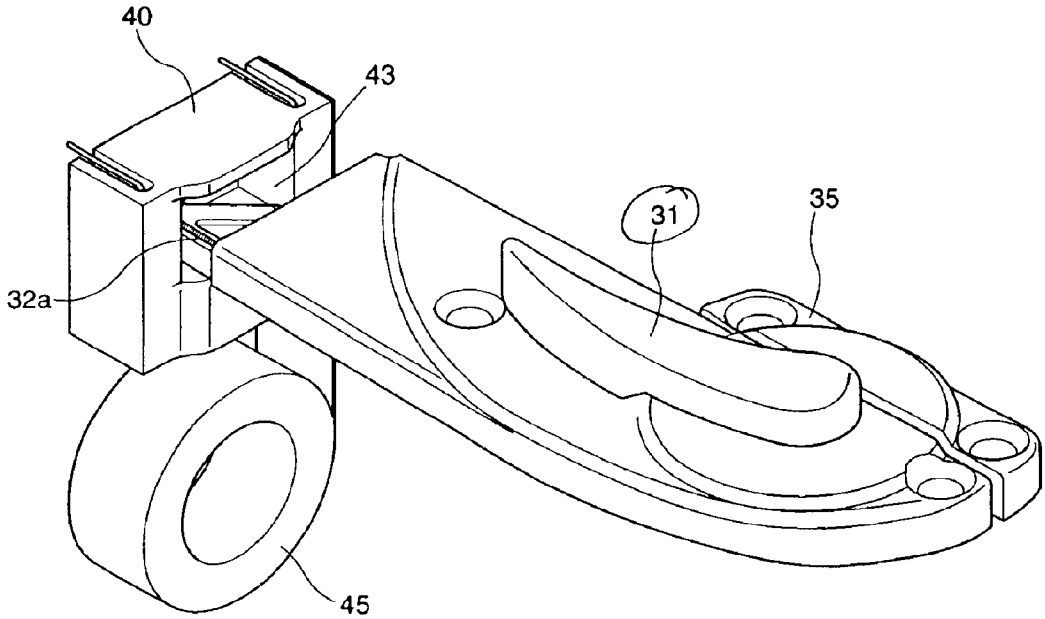
FIG. 6 illustrates the positioning of the nose portion of the tilt latch containing a magnet with respect to reed switches dispose on the counter spring block portion and illustrated in one embodiment of the invention.
Figure 7A:
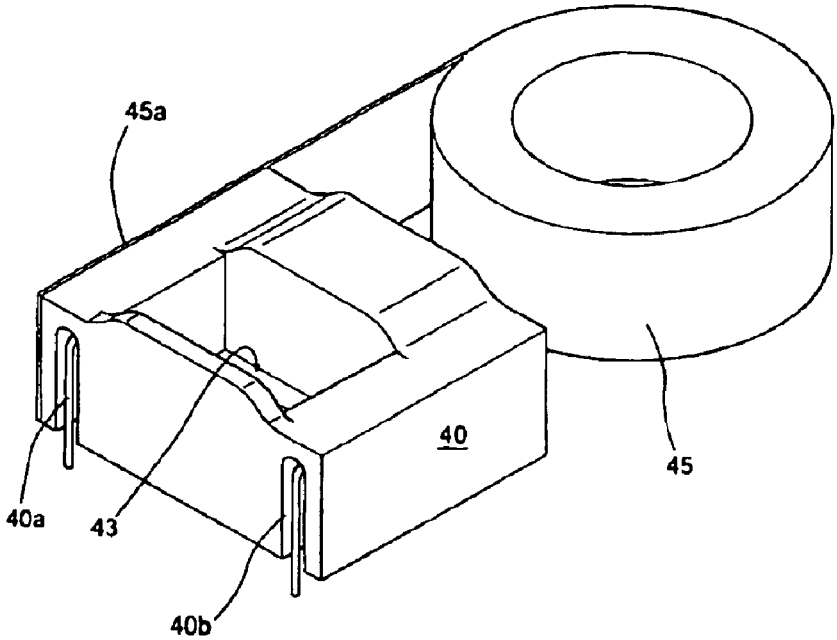
FIGS. 7A and 7B are assembled and exploded perspective views of the counter balance spring mounting block containing reed switches of a security system and illustrated in one embodiment of the invention.
Figure 7B:
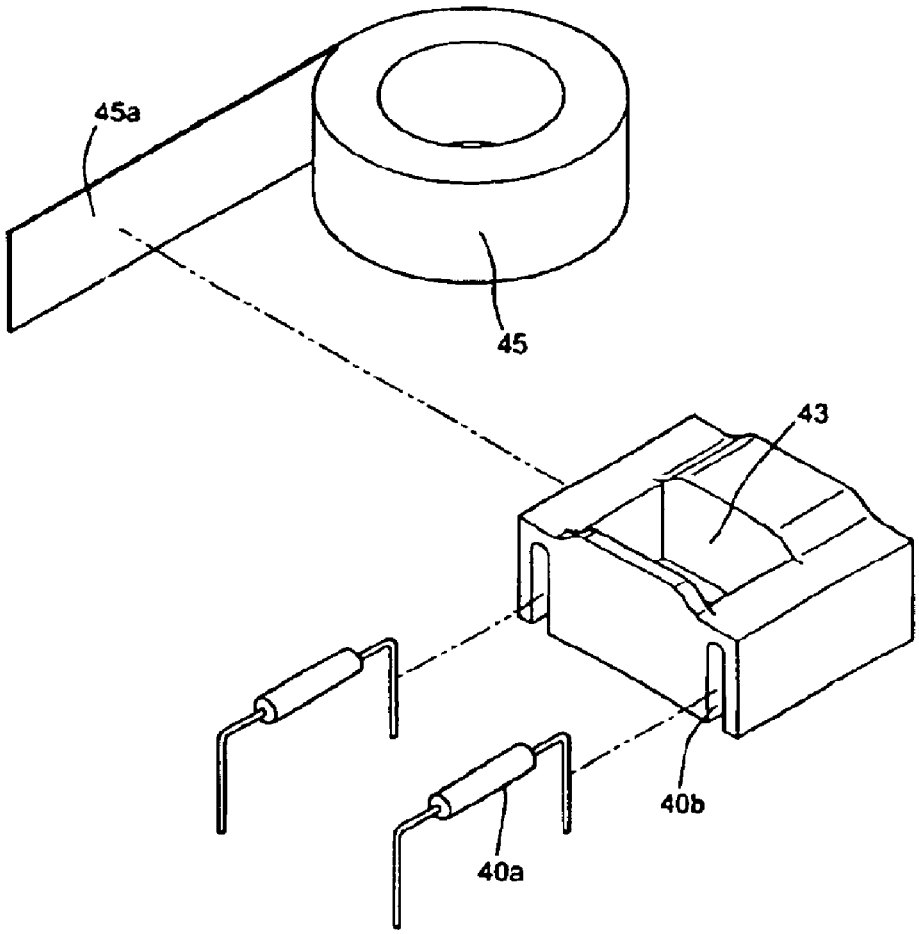

Referring now to FIGS. 4A, 4B and 4C is can be readily seen that the engaging of the cam-lock 34 with respect to the keeper 35 as seen in FIG. 1 will result in the locking of the inside window sash 27 with respect to the keeper 35 installed on the outside window sash sill 25*a* and coincidentally the tilt latch nose 32*b* being contained within the pocket 43 of the block 40 at the preferred hyper-extended position seen in ghost-line in FIG. 4A. Alternatively the nose portion 32*a* may assume an extended position at the locked and latched position of the lock/latch 30. At the locked position the nose portion 32*b* is at the preferred hyper extended position P1 as shown in the ghost line and further with reference to FIGS. 8A and 8B which will be described hereinafter. At the position of FIG. 4A the window is locked and latched and may not pivot nor slide within the track portion of the frame 20. Since the inside window sash 27 is locked to the sill of the outside window sash 25 neither window in a double hung assembly may be slide or pivot. In a single hung assembly of course then only the one window would move.

With reference FIG. 4B at this position of handle 31, the cam-lock 34 has disengaged from the keeper 35 yet the latch portion 32 is still engaged with the pocket portion 43 of the counter balance block 40 so as to enable the sliding of the inside sash 27 along with the assistance of the counter balance spring in the upward sliding motion and the resistance thereof in the downward sliding.

When the handle 31 is in the position of FIG. 4C the tilt latch 32 has released from the block 40 and from the pocket 43 thereof so that the window is now free to be opened for cleaning purposes and be tilted in an inward direction. The window will therefore pivot on the preferred pivot shoe of the present invention which will be described hereinafter.

Figure 8A:
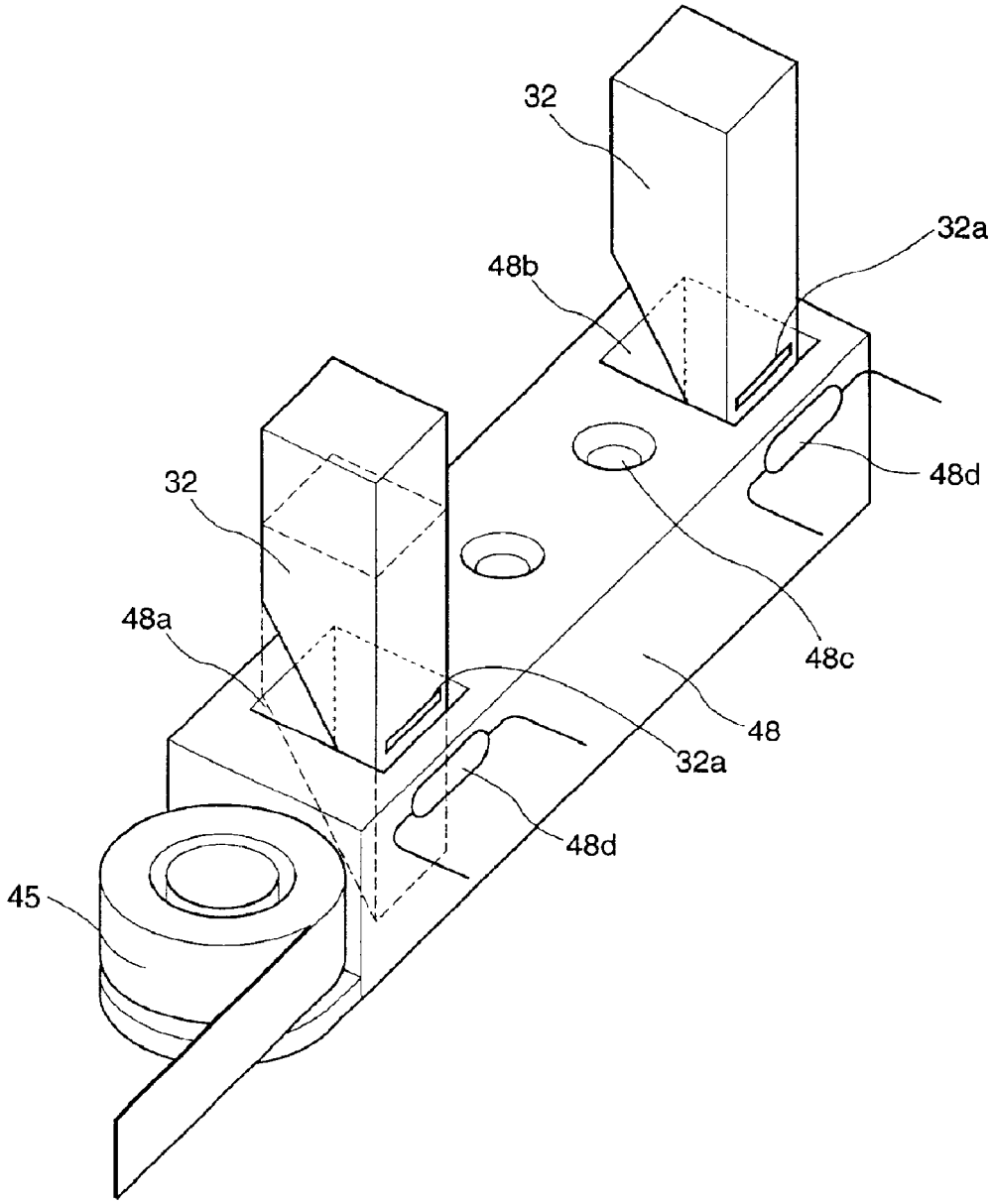
FIGS. 8A and 8B are schematic views of an alternative construction of a reinforcing block to that which is shown in FIGS. 7A and 7B illustrating a multiple position block for use with a security system illustrated in an alternative embodiment of the invention.
Figure 8B:
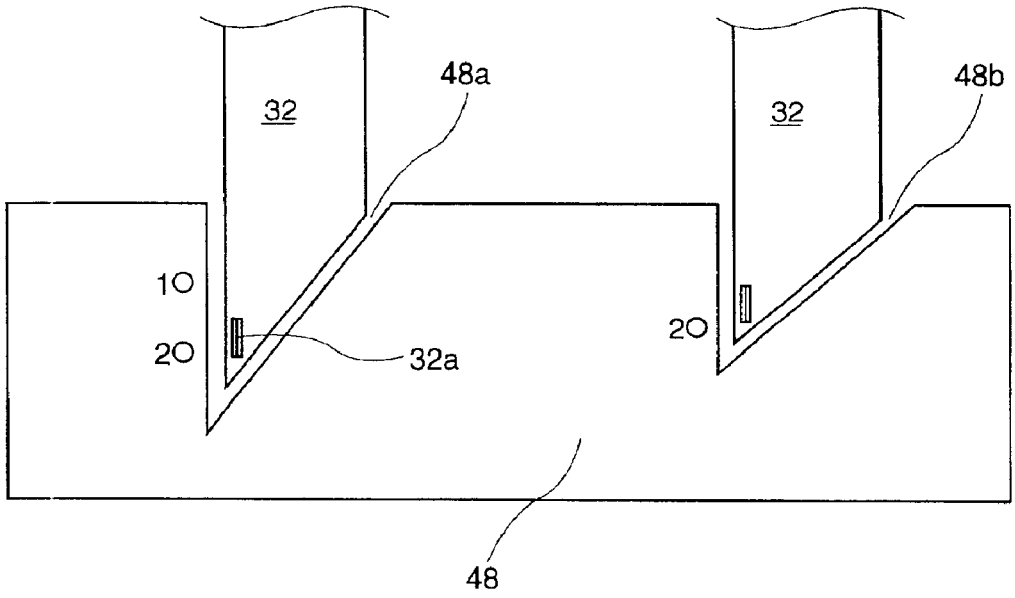

Referring now to FIGS. 5A, 5B, 6, 7A, 7B, 8A, and 8B, the components of the cam lock/tilt latch 30 are illustrated installed upon the header portion of an inside window sash 27 with the nose portion 32 contained within the pocket 43 of the block 40 so that the magnetic portion 32*a* installed within the tilt latch 32 is positioned inside pocket 43 adjacent to reed switches 40*a* to provide for various conditions fed back to an alarm security panel. As best seen in FIGS. 8A and 8B the nose portion 32 may include magnetic element 32*a* for positioning adjacent the reed switch 40*a* or in the case of 8A the reed switch 48*d* with the magnets 32*a* extending as shown in FIG. 8A. A block therefore 48 is provided installed within the track in position via a fastener 48*c* so that at the locked position the latch nose 32 hyper-extends into the pocket 48*b* and the magnet 32*a* of the nose 32 may be positioned with respect to and adjacent to position 1 or 2. Position 1 is a latched position which is available so that the window may be unlocked if desired and yet still with the security system armed at both the locked the latched position. At position 3 the nose 32 and magnet 32*a* is disposed at an alarmed position where the window may be slightly open vented at that position. The house holder therefore will know from the lights on their alarm security panel the position of the window whether locked, latched or on the vented night latch setting and whether in fact it is armed at these positions. Therefore with the simple provision of the appropriate transmitter/receiver combination in the latch/block these advantages can easily be obtained. Alternatively the cam-lock 34 may contain the magnet and the keeper 35 may contain the reed switch in order to provide the user with a simple add on lock/latch construction which may be used with a security system.

Figure 9:
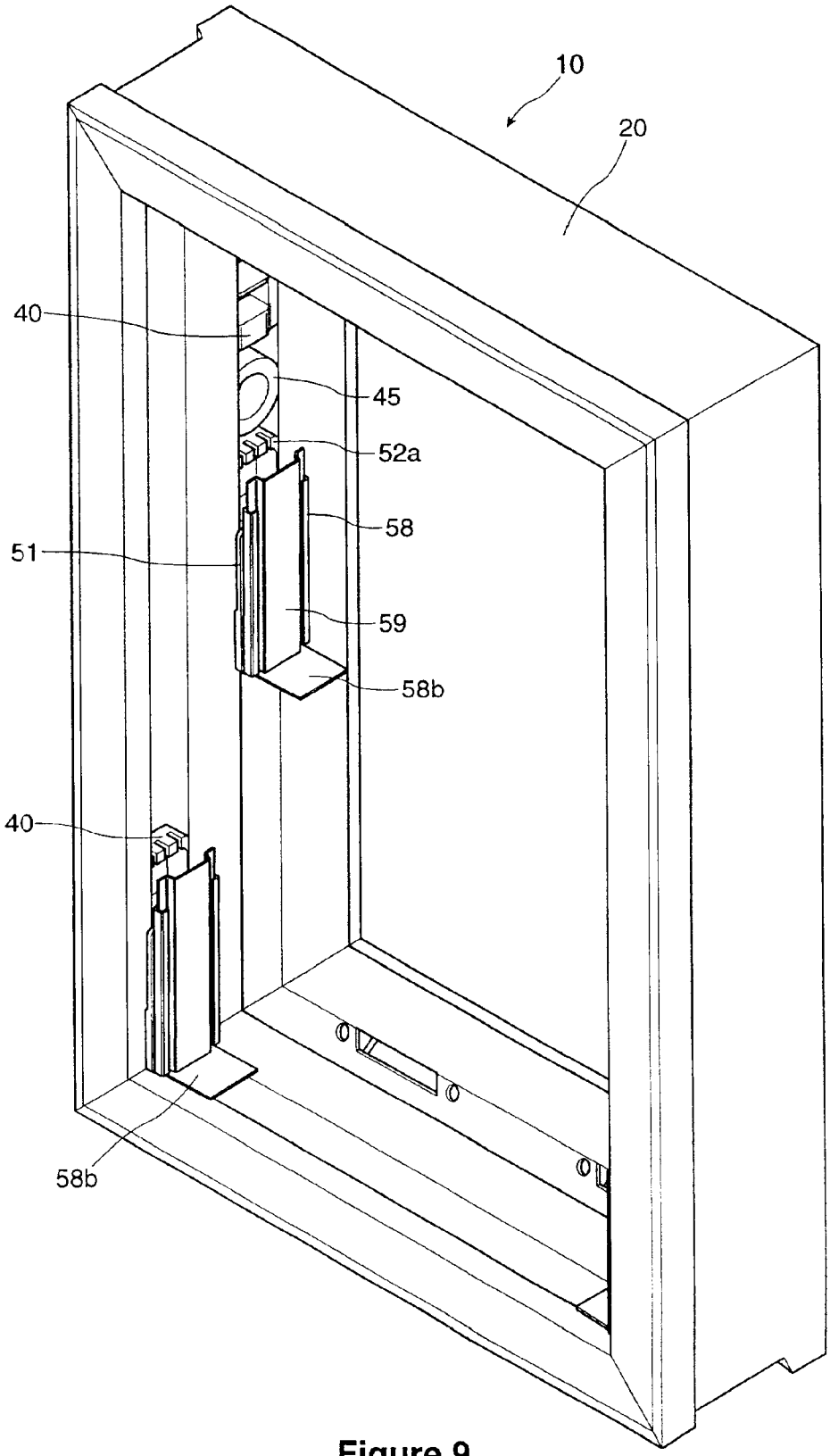
FIG. 9 is a perspective view of a window frame carrying the components of a locking pivot shoe engaged with the counter balance spring construction of FIGS. 7A and 7B.
Figure 10:
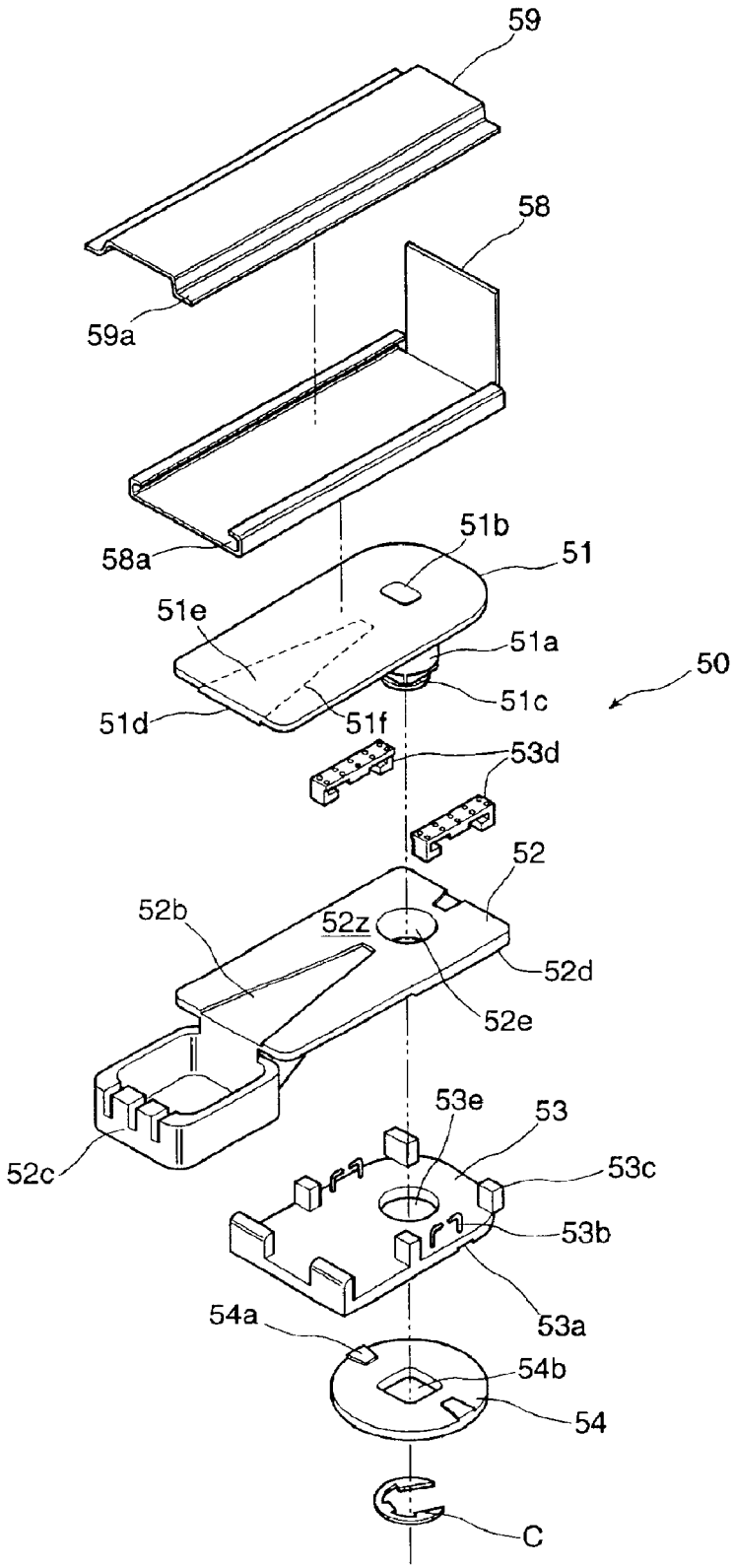
FIG. 10 is an exploded perspective view of components making up the zero clearance quick clamping pivot shoe illustrated in a preferred embodiment of the invention.
Figure 11A:
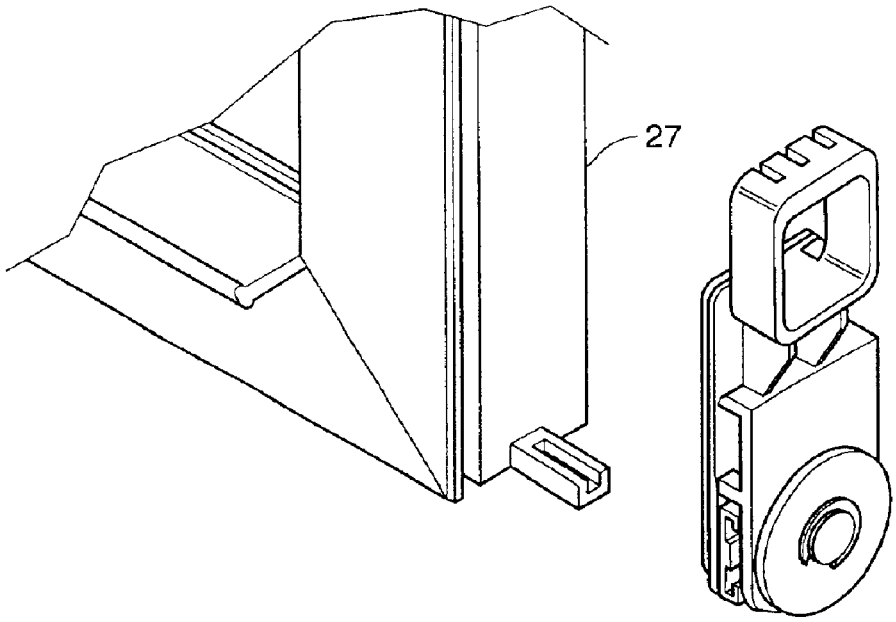
FIGS. 11A and 11B are schematic views of the attachment of a sash with the quick locking pivot shoe installed within a track of a window assembly and illustrated in a preferred embodiment of the invention.
Figure 11B:
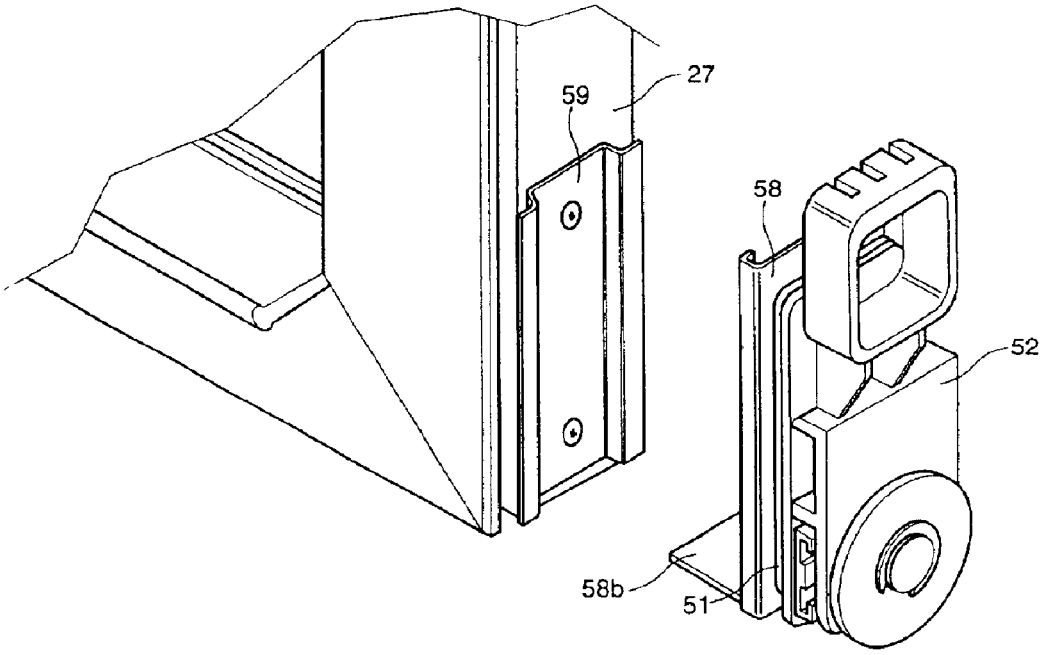

Referring to FIG. 9 there is illustrated the pivot components of the assembly 10 within the frame 20 with the sashes 25 and 27 removed as best seen in FIG. 10 having a pivot assembly 50 including a generally top hat shaped section 59 engageable via flanges 59*a* within the generally C-shaped section 58 within the channels 58*a* thereof. The portion 58 is engaged to via a pivot 58*b* shown in FIG. 11B to the opening 51*b* of a quick locking pivot shoe 50 and the camming plate 51 thereof having a cylindrical pin 51*a* passing through the entire assembly 50 to interconnect the parts in use to an end camming plate 54 through opening 54*b* and fastened there through via channel 51*c* by the C-clip C. A main clamping portion 52 carries a camming recess 52*b* for engagement with a compatibly shaped camming section 51*e* of camming plate 51. The clamping portion 52 also carries a counter spring engaging portion 52*c* for engagement with the counter balance spring and block assembly 40 and 45.

The supplementary clamping portion 53 including glide portions 53*c* which support the laterally extending flanges of the track (not shown) when the pivot shoe assembly 50 is free to move in the track. It is important that an absolute minimum clearance be provided between the track flanges and the land 52*d* and the glides 53*c* to ensure quick clamping of the pivot shoe when the sash is pivoted. Braking elements 53*d* engage with retaining portion 53*b* with the L shaped parts 53*b* fitting within the channel on the underside of braking elements 53*d* as shown in FIG. 10. The block portion 53 also includes a camming recess 53*a* compatible with and for engagement with camming parts 54*a* of the end plate 54. The pin or post 51*a* extends through openings 52*e*, 53*e* and 54*b* to retain the entire assembly of the pivot shoe 50 together when clipped via C-shaped clip C anchored into the channel 51*c* of said pin 51*a*.

The reader is referred to 11A and 11B for assembly of the pivot shoe with the sash. The bracket 59 is attached to the sash and the pivot assembly 50 is attached to the track and includes mounting bracket 58. The outwardly extending extension 58*b* of the bracket 58 captures the corner of the sash and may be affixed thereto via a convenient fastener (not shown).

The laterally extending track portion of the track of a window frame (not shown) therefore is carried in use between element 52*d* and glides 53*c*. The tolerance of this installation requires that there be an absolute minimum clearance between elements 52*d*, 53*c*, and the track portion. The camming part 51*e* of element 51, best seen in FIG. 10, normally rests within the camming recess 52*b* of portion 52. Equally the camming recess 53*a* normally contains the camming part 54*a*. However when the window is pivoted the camming parts 51*e* and 52*b* begin to disengage with the leading shoulder 51*f* of the camming part 51*e* riding over and on to the surface 52*z* provided with the camming part 52. Similarly the camming parts 54*a* of the end plate 54 ride out of and over the cut out 53*a*. This camming action of the main camming plate 51 and the clamping part 52 and further the camming action of the supplementary clamping part 53 and the bottom camming part 54 results in the substantially immediate movement of the two elements 52 and 53 toward one another so as to have the clamping elements 52*d* and 53*d* clamp against the track very quickly and approximately within one degree of rotation of the pivoting of the window sash. In this regard unlike U.S. Pat. No. 5,927,014 the clamping action takes place immediately prior to the free end of the pivoting window sash leaving the track portion of the frame 20 to ensure that the window seals are not compressed by sagging of the sash nor the sash is not inadvertently displaced from the track. Therefore the objectives accomplished by the prior patent of Mr. Shaul Goldenberg U.S. Pat. No. 5,927,014 to prevent sagging of the sash and the like are accomplished in a much simpler less expensive arrangement.

Figure 12:
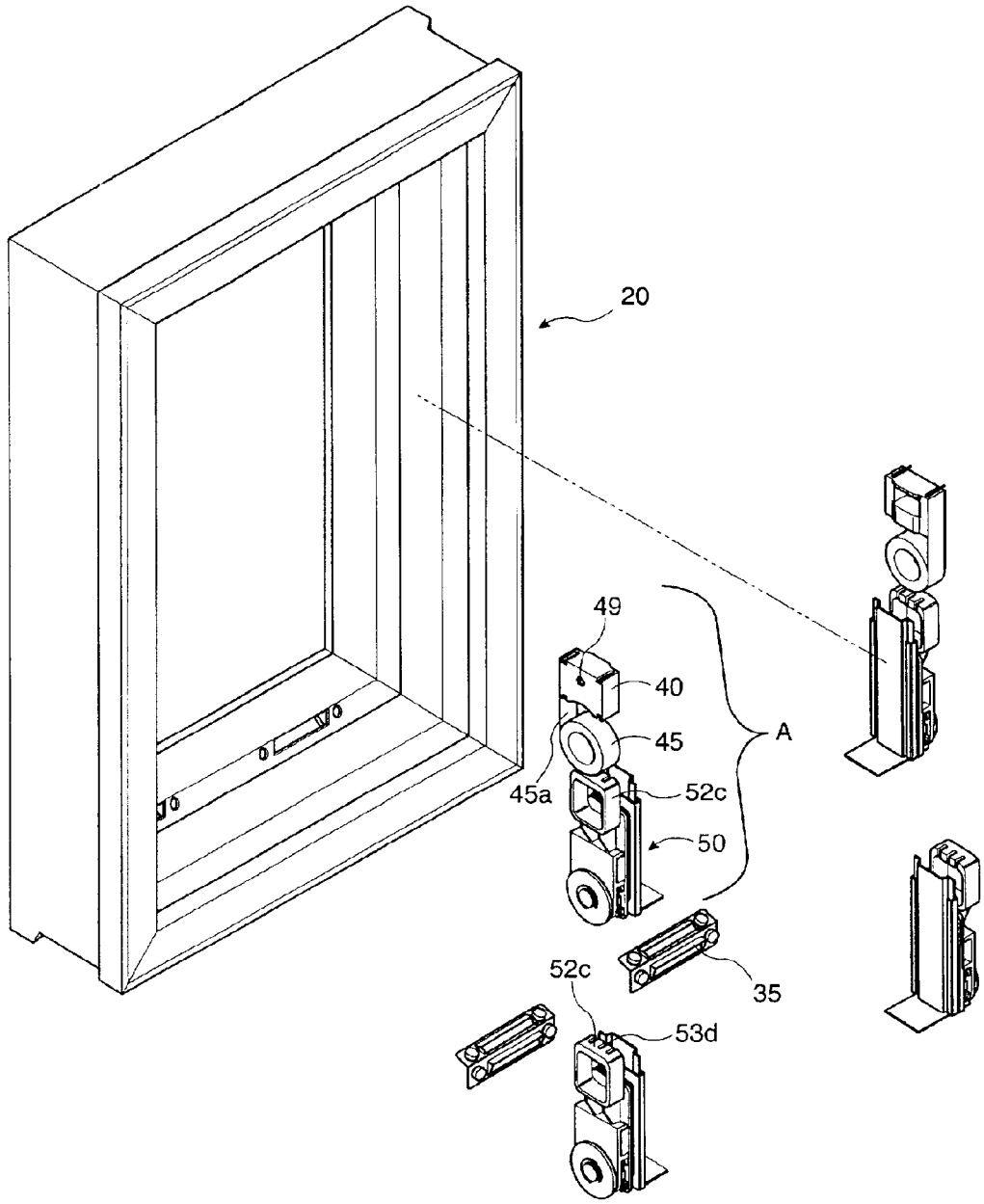
FIG. 12 is an exploded view of a double hung window embodying elements of the invention with the window sash removed and illustrated in a preferred embodiment of the invention.
Figure 13:
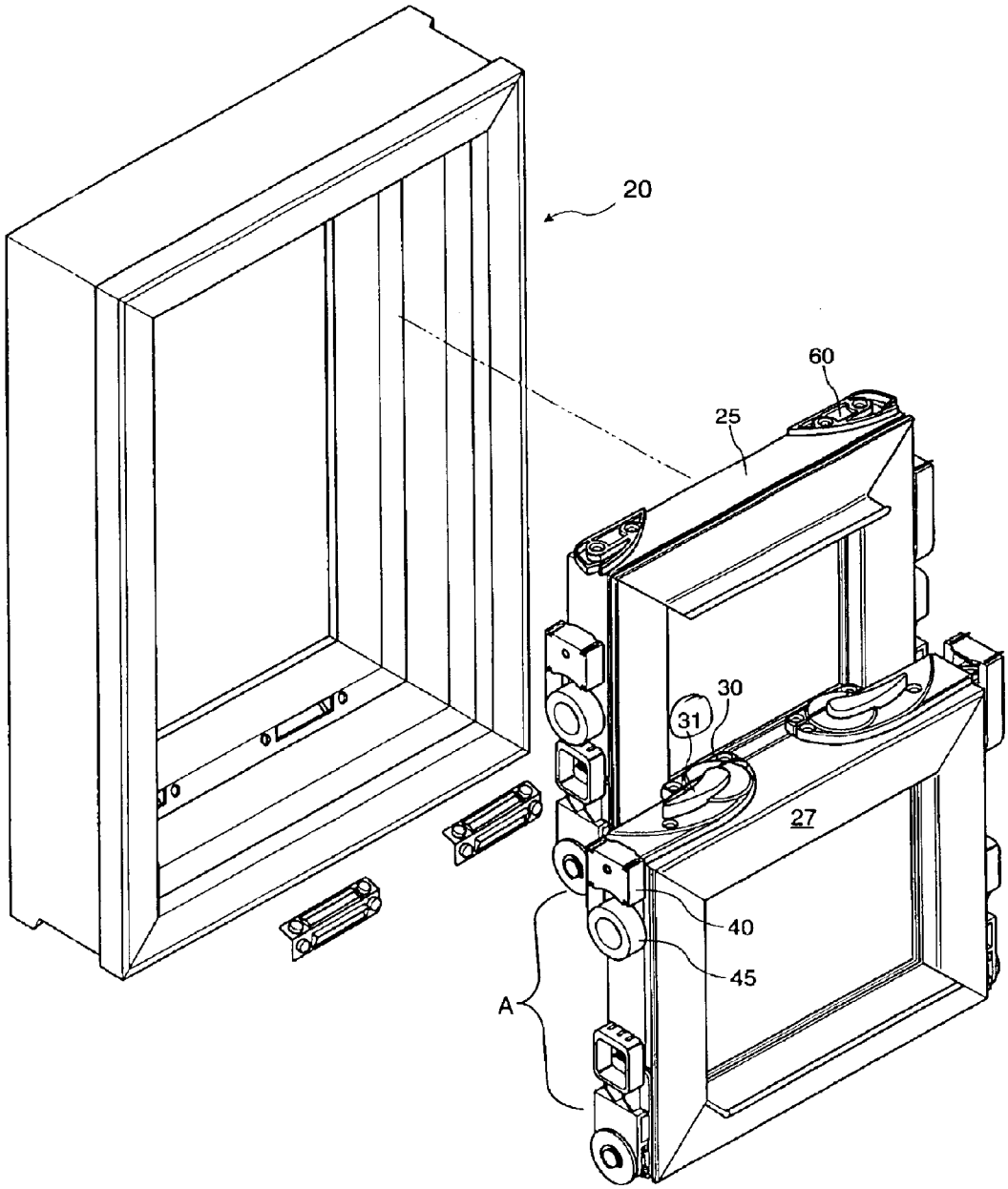
FIG. 13 is similar to that of FIG. 12 with both the inner and outer window sashes of a double hung window assembly being illustrated.
Figure 13A:
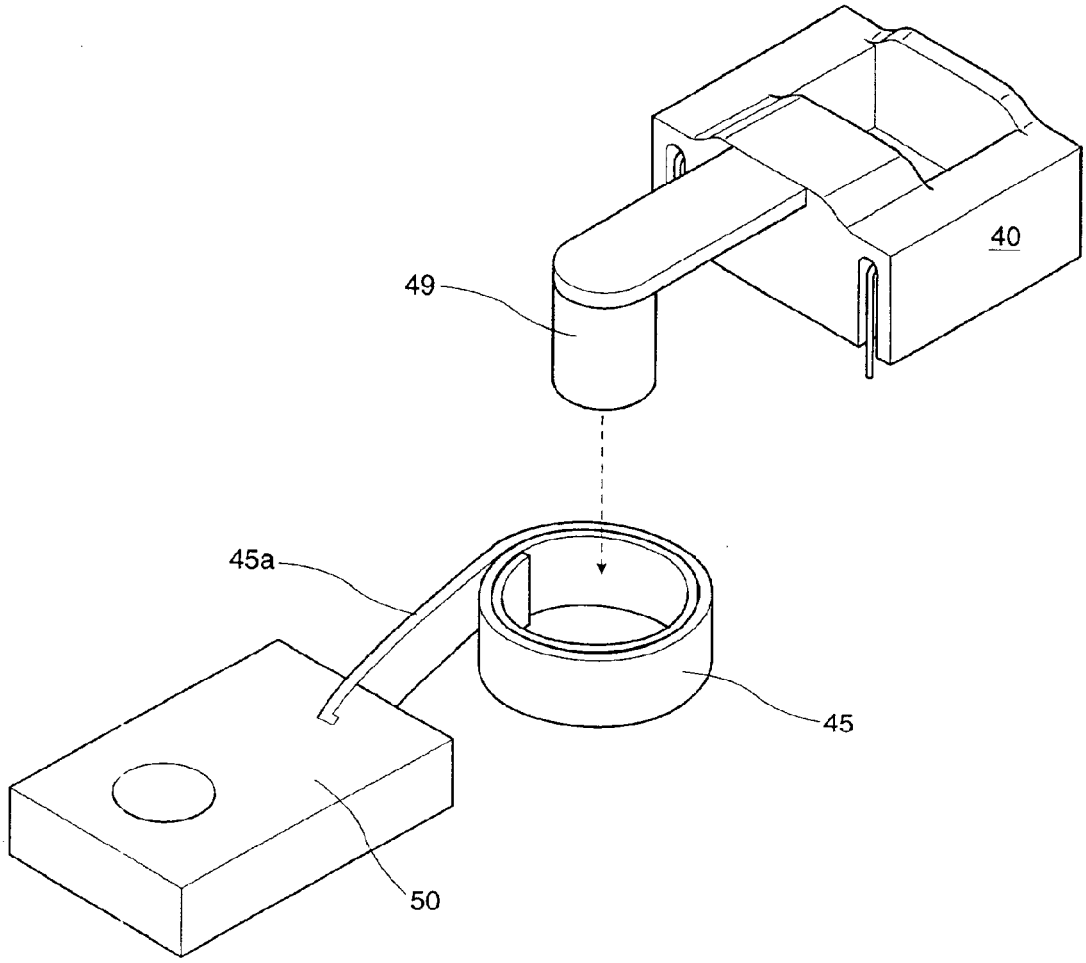
FIG. 13A is a schematic view of the assembly A of FIG. 12 illustrating in detail the interrelationship of the components illustrated in another embodiment of the invention.

Referring to FIGS. 12 and 13 and 13A there is illustrated the assembly A which includes the block 40, the spring 45 preferably mounted on a pivot part 49 of the block 40 so as to be free to rotate with the free end 45*a* being engaged with the pivot shoe 50 via extension 53 in the slots 53*d* as best seen in FIG. 13 A. The assembly A is assembled and interconnected as a unit and utilized and installed within the frame portion of a double hung assembly with keeper portion 35 installed appropriately. In FIG. 13 the inside and outside sash elements 25 and 27 are installed within the frame 20 with all of the components installed therein including the assembly A and a novel one piece outside latch 60. Wiring is provided within the frame section to engaged with the reed switches provided with the blocks 40 and with the wiring being accessible to an installer and to be made available to any alarm security system installer. The wiring is pre-installed to avoid reducing the integrity of the seals of the window which would be a result of a separate installation. Unique alarming conditions are therefore provided via a very simple system. Further the water path is not affected and any sealing conditions of the window are not harmed as might be a result of a surface mounted system.

Figure 14:
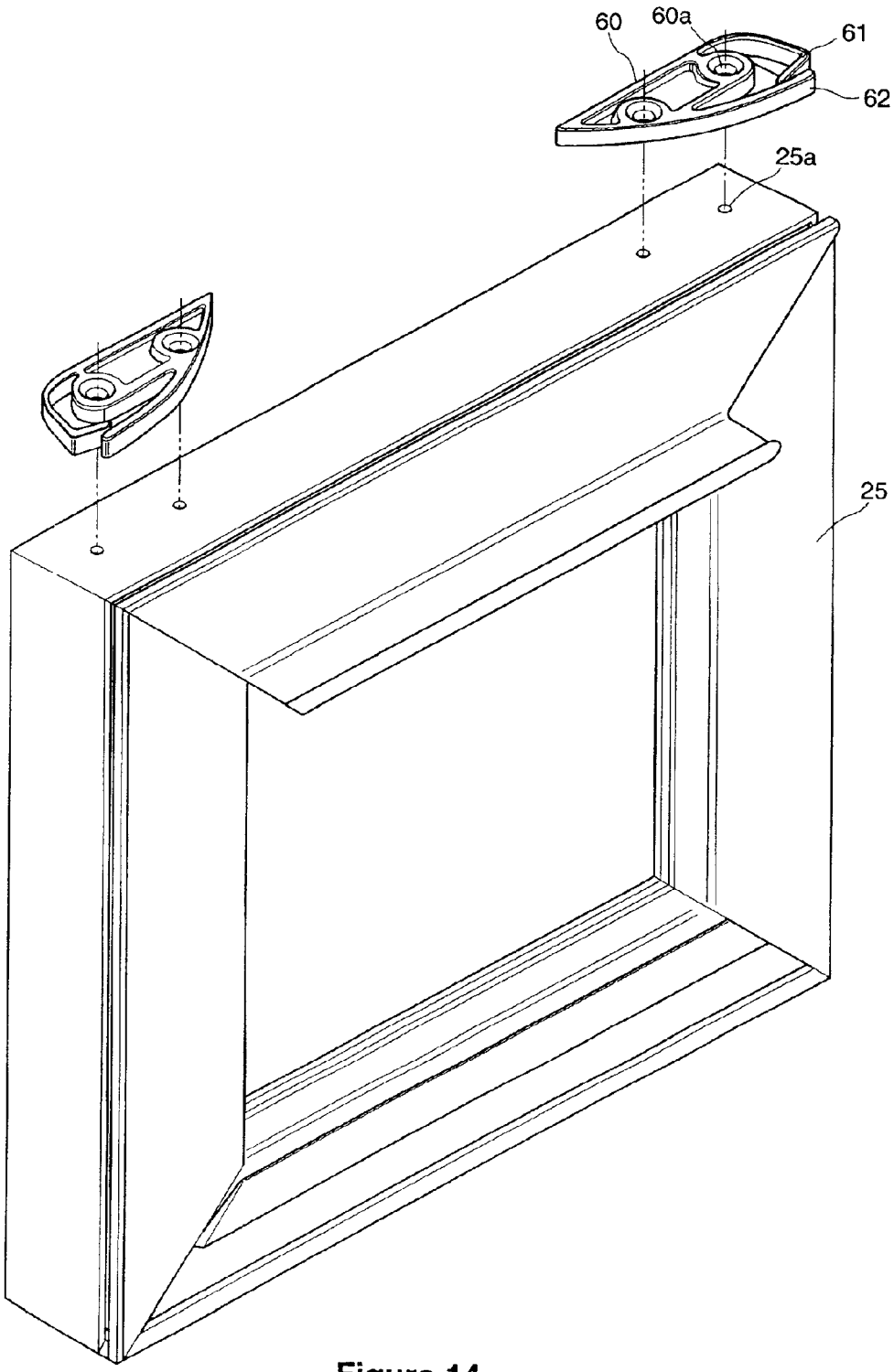
FIG. 14 is an exploded perspective view of the outside window sash of FIG. 1 illustrating a simple one piece tilt latch construction installed on the top thereof and shown in a preferred embodiment of the invention.
Figure 15:
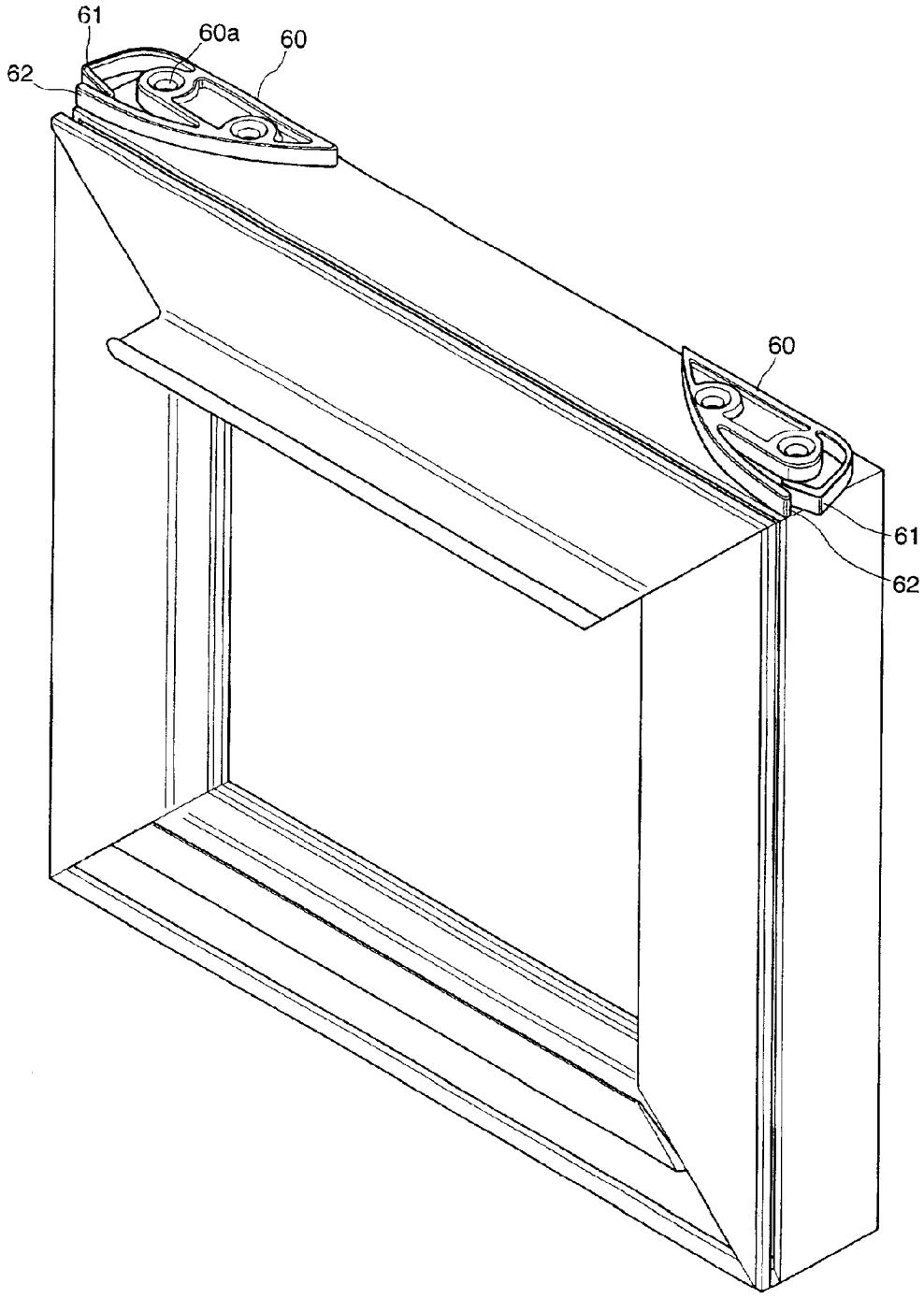
FIG. 15 is an illustration similar to FIG. 14.
Figure 16:
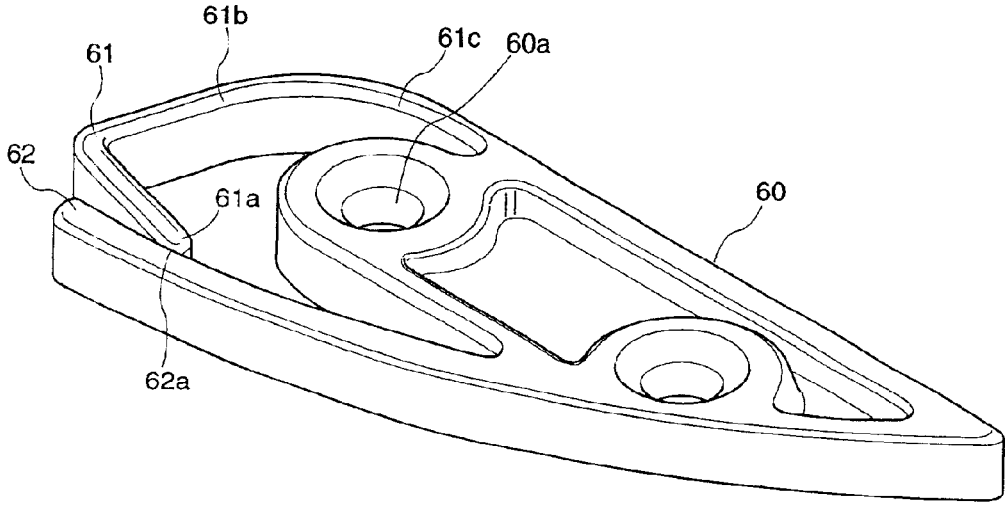
FIG. 16 is a perspective view of the one piece tilt latch of FIGS. 14 and FIG. 15 illustrated in a preferred embodiment of the invention.

Referring now to FIGS. 14, 15 and 16 there is shown a unique one piece outside tilt latch 60 for outside window sash 25 installed on the header of said window frame part through parts 25*a* and 60*a*. The one piece latch 60 therefore is best seen in FIG. 16 includes a latching part 61 which may engage a block part pocket 43 of a block 40 or any convenient block or track portion and which is sufficiently flexible by providing flexible knuckles 61*d* and 61*c* so as to be removable from the track or pocket 43 by the flexing thereof as the window sash is pulled in an inward direction flexing of finger 61 resulting in a removal of the finger 61 of element 60 from the track or alternate block being utilized. A pulling force of approximately 40 lbs. is required on the sash to release the finger 61 from the track or block 40. This pulling action eliminates the need to operate a finger pull or the like as is known on prior structures which simplifies the release process for the homeowner. The latch 60 requires a minimal loading ability since it is installed only on the outside window sash in the preferred embodiment which is sufficient to keep the window in its latched positioned and yet still being available to slide in the track. The portion 62 engages the portion 61 so as to provide additional strengthening of the finger 61 of the simple latch 60.

As many changes can be made to the preferred embodiments of the invention without departing from the scope thereof; it is intended that all matter contained herein be considered illustrative of the invention and not in a limiting sense.

The embodiments of the invention in which an exclusive property or privilege is claimed are as follows:

1. A combination self contained lock/latch for a window assembly for installation on a moveable sash adjacent a track jamb of the window assembly, said combination lock/latch comprising:

i) a housing for said lock/latch having an opening extending therewith;

ii) a rotatable camlock disposed in the housing, a spindle or alternatively a tab connected to said camlock and extending therefrom through the opening of said housing and having a user accessible part or handle; said camlock having an engaging portion for rotatable engagement/disengagement with a keeper or slot affixed to or disposed with a framing part or an outside sash of said window assembly, said camlock having a first detent provided therewith for rotatable engagement with a second detent of a one piece biased tilt latch provided within the housing, only after the engaging portion has disengaged the slot or keeper;

iii) the one piece biased tilt latch being entirely disposed within said housing and being moveable in said housing on the surface of said sash, said tilt latch having two ends and being biased to a latched position, said tilt latch having a nose portion proximate one end thereof and a detent portion proximate the other end thereof, said tilt latch for engaging a track proximate the nose portion thereof, and in one embodiment in a latch block proximate said track having at least one pocket for receiving said nose portion of the latch, and in another embodiment said nose extending further into said track or block so as to provide the sash with a higher wind pressure loading capability, said latch also for engagement with the detent of the camlock proximate the detent of said tilt latch proximate the other end thereof, said latch being biased to the track, or block, engaging position prior to being released by rotation of the camlock when the engaging portion has disengaged the keeper, wherein said lock/latch combination is fully contained within said housing and may be easily mounted on the moveable sash without further operating requirements and which obviates the need for a separate cam-lock and a separate tilt latch.

2. The lock/latch of claim 1 further comprising a shoulder and the detent of said tilt latch is a tab disposed at the end of a flexible finger, these parts engaging to convert the rotary motion of said cam-lock to linear motion of said tilt latch.

3. The lock/latch of claim 2 wherein a return spring is disposed within said housing to engage the tilt latch intermediate said nose and said tab to bias the sliding linear motion of said latch to the track engaging position.

4. The lock/latch of claim 1 or 2 wherein the keeper or slot may further comprise a receiver/transmitter for an alarm system while the camlock includes the corresponding transmitter/receiver.

5. The lock/latch of claim 3 wherein the keeper or slot may further comprise a receiver/transmitter for an alarm system while the camlock includes the corresponding transmitter/receiver.

* * * * *

UNITED STATES PATENT AND TRADEMARK OFFICE

CERTIFICATE OF CORRECTION

PATENT NO. : 6,871,885 B2
DATED : March 29, 2005
INVENTOR(S) : Shaul Goldenberg and Sean Davies It is certified that error appears in the above-identified patent and that said Letters Patent is hereby corrected as shown below:

Column 9,
Line 45, delete “the” and insert -- either -- and after “pocket” and before “48b” insert -- 48a or --.
Line 49, insert -- and -- between “the locked the latched”.
Line 50, delete “3” and insert -- 2 --.

Signed and Sealed this

Seventh Day of March, 2006

JON W. DUDAS
*Director of the United States Patent and Trademark Office*